US005605328A

United States Patent [19]

Rudell et al.

[11] Patent Number: 5,605,328

[45] Date of Patent: Feb. 25, 1997

[54] TABLETOP BASKETBALL GAME WITH PLAY FIGURES ON OPERABLE RODS

[75] Inventors: Elliot A. Rudell, 1619 Gramercy Ave., Torrance, Calif. 90501; George Foster, Signal Hill, Calif.; Roger Gardner, Lomita, Calif.; Ian Osborne, Manhattan Beach, Calif.

[73] Assignee: Elliot A. Rudell, Torrance, Calif.

[21] Appl. No.: 658,979

[22] Filed: Jun. 4, 1996

Related U.S. Application Data

[63] Continuation of Ser. No. 348,536, Dec. 1, 1994, abandoned.

[51] Int. Cl.[6] ..... A63F 7/06

[52] U.S. Cl. ..... 273/108.1; 273/108.51; 273/108.52

[58] Field of Search ..... 273/1.5 R, 85 R, 273/94, 85 B, 85 C, 85 D, 85 F, 118 R, 108.1, 108.4, 108.51, 108.52, 108.53, 108.54, 108.55; 463/50

[56] References Cited

U.S. PATENT DOCUMENTS 2,779,597 1/1957 Barbolla ..... 273/85 D 4,260,152 4/1981 Karlsen ..... 273/85 D

FOREIGN PATENT DOCUMENTS 1085457 2/1955 France ..... 273/85 D 508780 1/1955 Italy ..... 273/85 D

*Primary Examiner*—William M. Pierce

*Attorney, Agent, or Firm*—Blakely Sokoloff Taylor & Zafman

[57] ABSTRACT

A table top basketball game which has a plurality of player figures that can be manipulated by opposing players and which can project a ball into a hoop. The player figures are attached to rods that extend across a floor. The rods have handles which allow the players to spin and laterally move the figures. The rods and player figures are separated and arranged so that the ball can be "passed" from one player figure to another player figure, while the player figures of the opposing player are manipulated to "steal" the pass. The rods can also be rotated to spin the player figures and project the ball into a hoop. The floor has a plurality of recess areas that cause the ball to roll to the player figures and increase the action of the game. The game may have a pair of "center" player figures that are moved in a vertical direction to impede the projection of the ball into the hoop.

10 Claims, 3 Drawing Sheets

TABLETOP BASKETBALL GAME WITH PLAY FIGURES ON OPERABLE RODS

This is a continuation application of application Ser. No. 08/348,536, filed Dec. 1, 1994 now abandoned.

BACKGROUND OF THE INVENTION

1. Field of the Invention

The present invention relates to a table top basketball game.

2. Description of Related Art

There have been marketed table games that simulate the action of a sport. For example, there is a table size game commonly referred to as FOOSBALL that simulates the game of soccer. A FOOSBALL table contains a plurality of player figures that are mounted to a number of rods which extend across a playing surface. Each player moves and rotates the player figures to move a ball across the table. The object of the game is to roll the ball past a "goalie" player figure and into a slot located at the end of the playing surface.

There have also been marketed games that simulate the game of basketball. For example, Milton Bradley Co. and Cadaco Games have marketed table top basketball games under the trademarks HOT SHOT BASKETBALL and SUPER SLAM BASKETBALL, respectively. These games typically have a single player figure which contains a spring loaded device that projects a ball into a basketball hoop. The hoop can be moved relative to the player figure to increase the skill level of the game. The Milton Bradley and Cadaco games are limited to one action player figure and thus do not simulate a basketball game with 10 players. Additionally, the table top basketball games of the prior art do not include active participation by the opposing player during the game. It would therefore be desirable have a table top basketball game that requires active participation by the opposing players and more simulates the shooting, passing, defensive actions, etc. of a real basketball game.

SUMMARY OF THE INVENTION

The present invention is a table top basketball game which has a plurality of player figures that can be manipulated by opposing players to project a ball into a hoop. The player figures are attached to rods that extend across a floor. The rods have handles which allow the players to spin and laterally move the figures. The rods and player figures are separated and arranged so that the ball can be "passed" from one player figure to another player figure, while the player figures of the opposing player are manipulated to "steal" the pass. The rods can also be rotated to spin the player figures and project the ball into a hoop. The floor has a plurality of recess areas that cause the ball to roll to the player figures and increase the action of the game. The game may have a pair of "center" player figures that are moved in a vertical direction to impede the projection of the ball into the hoop. The game typically contains four rods and ten players located above a board that can be placed on a table top.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
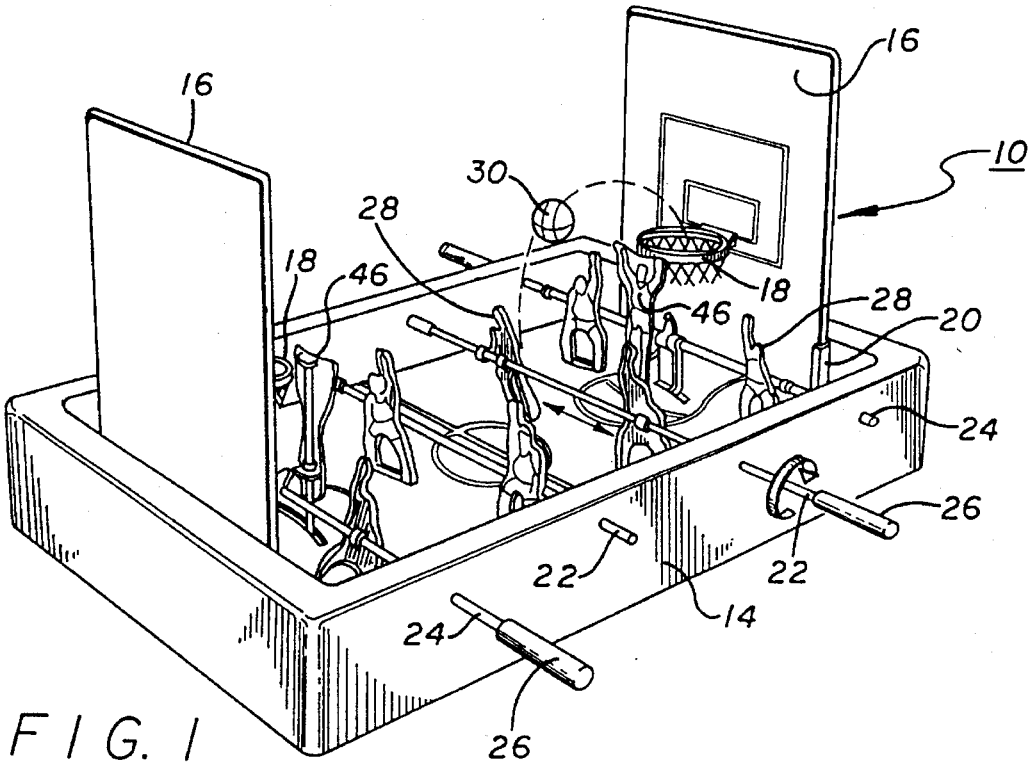
FIG. 1 is a perspective view of a table top basketball game of the present invention.
Figure 2:
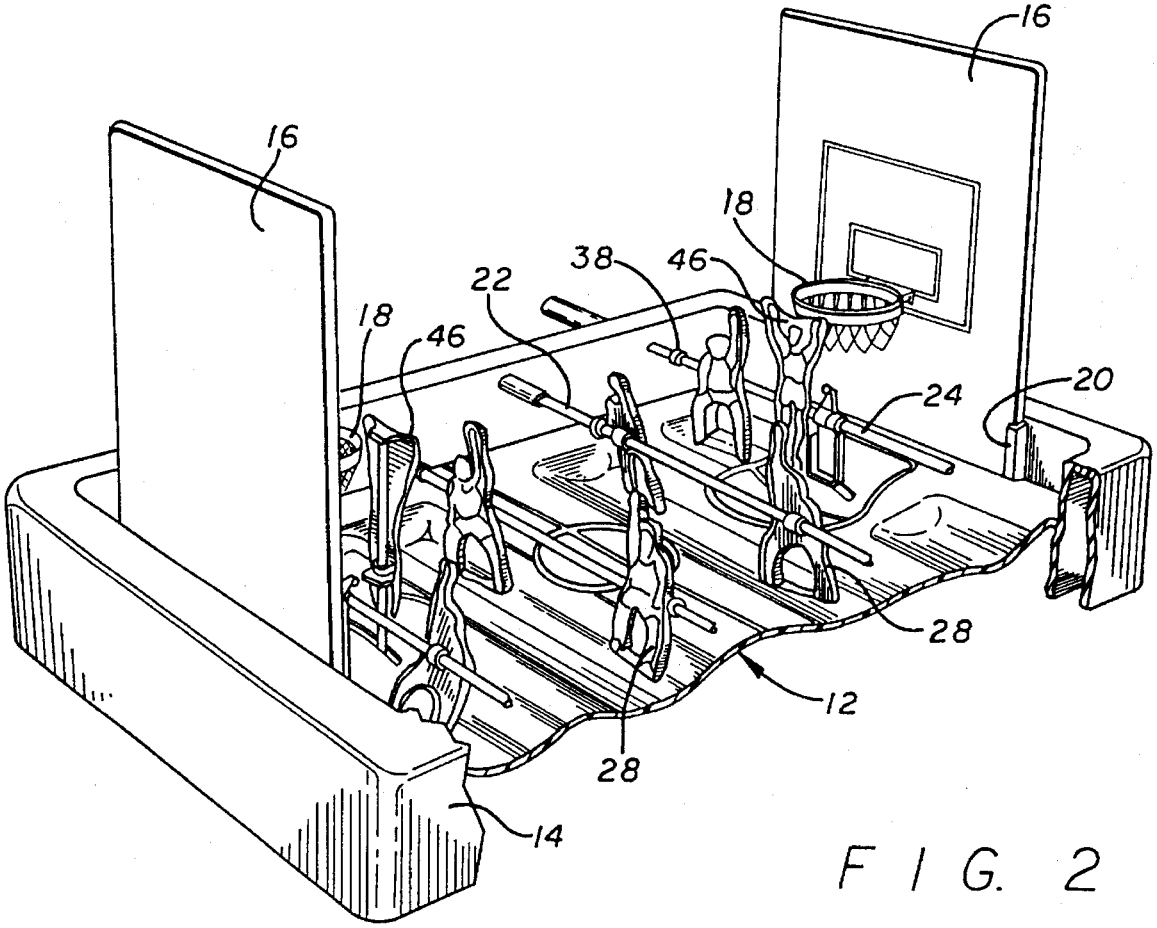
FIG. 2 is an enlarged perspective view of the basketball game.

Referring to the drawings more particularly by reference numbers, FIGS. 1 and 2 show a table top basketball game 10 of the present invention. The game 10 is typically small enough to be placed on a table and operated by two opposing players. Although operation of the game by two opposing players is described, it is to be understood that more than two players can participate in the game.

The game 10 has a floor 12 that is attached to walls 14. Both the floor 12 and the walls 14 can be constructed from a molded plastic material. The floor 12 may have indicia that simulate the three second lines, center line, etc. of a basketball court. Extending from each end of the floor 12 is a backboard 16. Mounted to each backboard 16 is a hoop 18 that is suspended above the floor 12. Each hoop 18 may have a net to more simulate a basketball court. Each backboard 16 can be constructed as a molded plastic plate that is captured by a pair of brackets 20 mounted to the wall 14. The backboards 16 can slide out of the brackets 20 so that the players can more easily transport and store the game.

The game has a pair of first rods 22 and a pair of second rods 24 that extend across the width of the floor 12. The rods 22 and 24 extend through openings in the walls 14. Each rod 22 and 24 has a handle 26 that can be manipulated by the players to move the rods laterally across the width of the floor 12 as indicated by the arrows. Additionally, each rod can be spun about the longitudinal axis of the rod. Each rod 22 and 24 may be constructed from a hard plastic or metal material that creates a relatively small amount of friction between the outer rod surface and the openings of the walls 14. The wall openings can be elliptical in shape to allow the rods 22/34 to be moved in fore and aft directions relative to the floor 12.

The game 10 has a plurality of first player figures 28 attached to the rods 22 and 24. Each rod 22 and 24 has two separate first player figures 28. The player figures 28 are manipulated by the game participants to move and project a ball 30. It is an object of the game 10 to project the ball through the hoop 18 of an opposing player.

Figure 3:
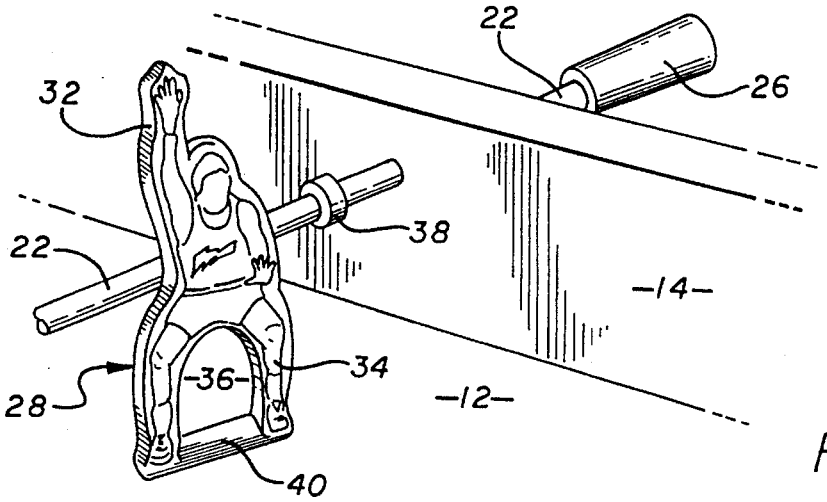
FIG. 3 is an enlarged perspective view showing a player figure attached to a rod.

As shown in FIG. 3, the player figures 28 generally have the outline of a basketball player, including an upper arm portion 32 that is used to impede the motion of the ball 30. The base portion 34 of each figure 28 may have an opening 36 that captures the ball 30. Each rod 22 and 24 may have a pair of stops 38 that prevent the figures 28 from striking the sides of the walls 14 when moved in a lateral direction.

Figure 4:
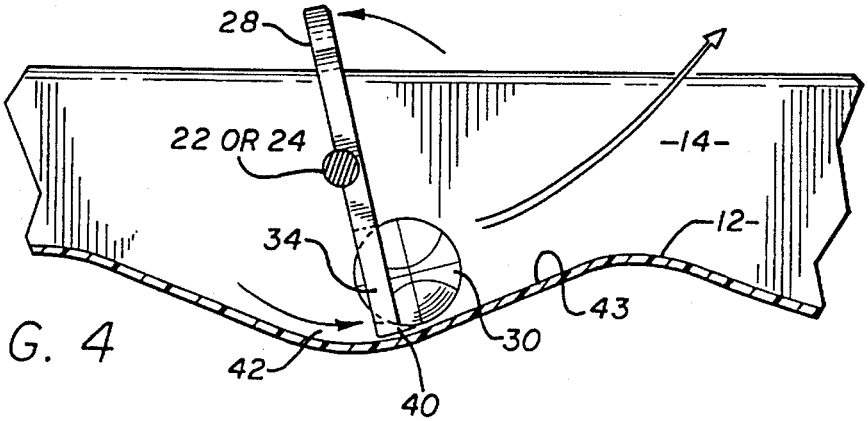
FIG. 4 is a side view showing a player figure that is rotated to project a ball.

As shown in FIG. 4, spinning a rod 22 or 24 will rotate the player figure 28 and project the ball 30 toward the hoop 18. Each player figure 28 may have a lower foot portion 40 that assists in capturing and projecting the ball 30. The lower first portion 40 has an angled surface that directs the ball 30 in an upward direction when the rod 22/24 is rotated.

Figure 5:
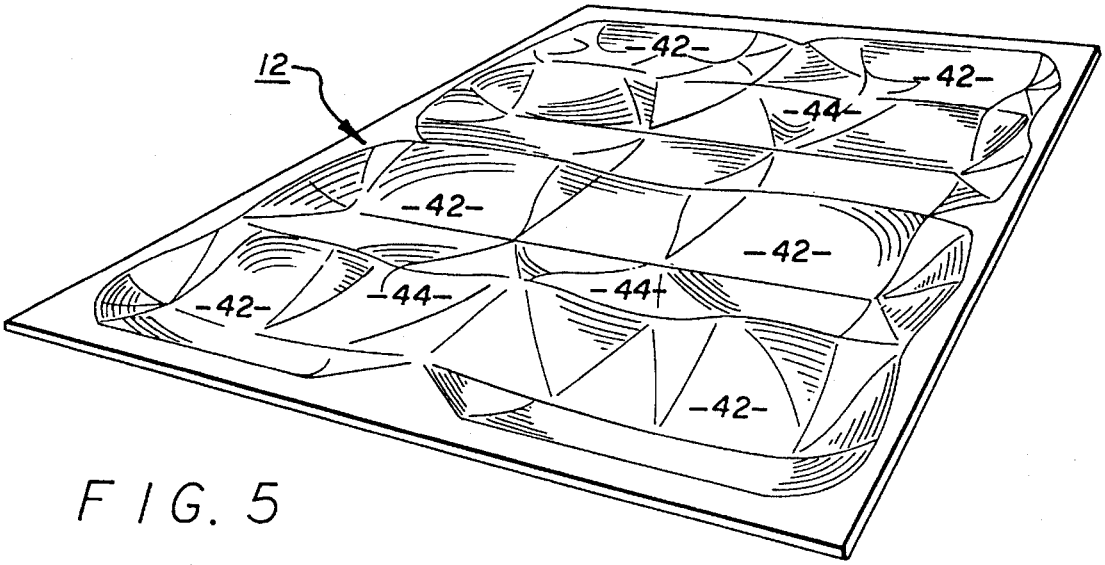
FIG. 5 is a perspective view of a floor.

As shown in FIG. 5, the floor 12 may have a contoured surface that creates a plurality of player recess areas 42. As shown in FIG. 4, the recess areas 42 are adjacent to the base portions 34 of the player figures 28. The recess areas 42 cause the ball 30 to roll into contact with figures 28. The recess areas 42 eliminate points on the floor that are inaccessible to the figures 28 ("dead spots") and generally increase the speed of the game by inducing contact between the ball 30 and the figures 28. Additionally, the recess areas 42 also create ramping surfaces 43 that may assist the upward projection of the ball 30. Referring to FIG. 5, the floor 12 may have additional recess channels 44 that allow the players to more readily pass the ball 30 between figures 28.

Figure 6:
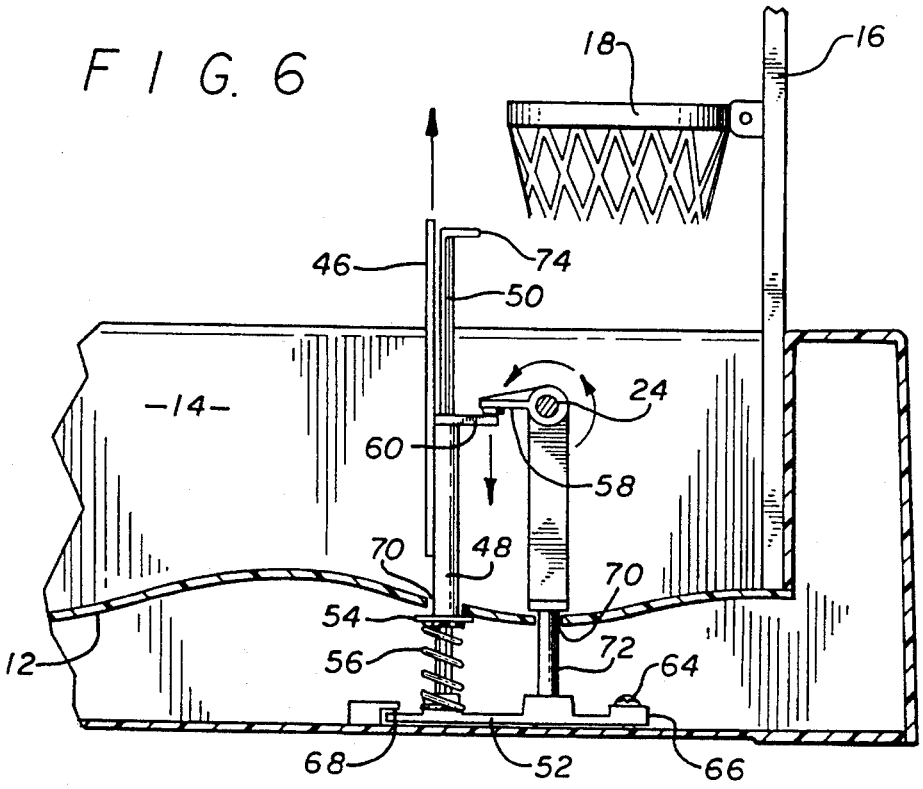
FIG. 6 is a side view showing a second player figure that can be moved in a vertical direction toward a basketball goal.
Figure 7:
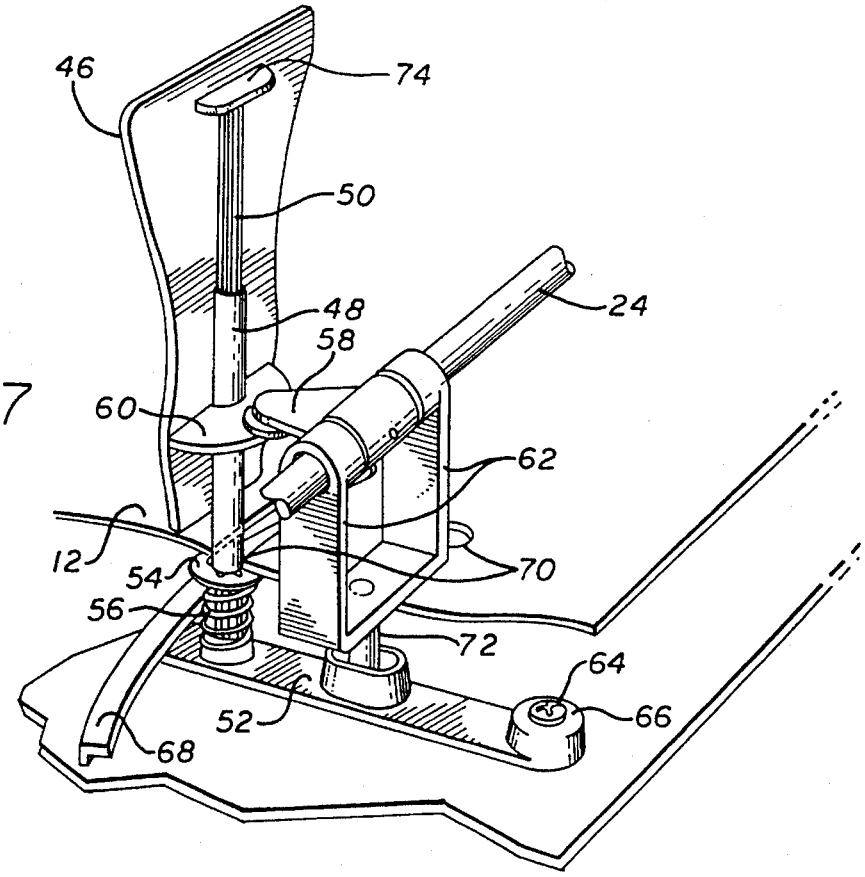
FIG. 7 is a perspective view of the second player figure.

As shown in FIGS. 6 and 7, the game 10 may also have a pair of second "center" player figures 46 that are adjacent to the hoops 18. The game participants can manipulate the second player figures 46 to move in a vertical direction relative to the floor to impede the projection of the ball 30 through the hoops 18. Each second player figure 46 has a sleeve 48 that slides along a shaft 50 that is mounted to a swing arm 52. The sleeve 48 is adjacent to a collar 54 that is located below the floor 12. The collar 54 and swing arm 52 capture a spring 56.

Each second rod 24 has a lever 58 that engages a flange 60 of the second player figure 46. The lever 58 is captured by a pair of support arms 62 which are mounted to the swing arm 52. The swing arm 52 is pivotally connected to the floor 12 by a screw 64 and bushing 66 assembly. Movement of the swing arm 52 can be guided by a channel 68 mounted to the floor 12. The second player figures 46 can be moved in a lateral direction by pulling or pushing the second rods 24. The floor 12 has a pair of slots 70 to provide clearance for the mounting sleeve 48 and a support bar 72 of the support arms 62.

Each second player figure 46 can be moved in a downward vertical direction by rotating the second rod 24 to initially push the figure 46. Movement of the figure 46 compresses the spring 56. Continued rotation of the rod 24 disengages the lever 58 from the flange 60, wherein the force of the spring 56 pushes the figure 46 in an upward direction. Gravity returns the second player figure 46 to the original position. The second figure 46 may have a stop 74 that limits the downward movement of the figure 46. Rotation of the rod 24 may be continued until the lever 58 is back in the original position.

In operation, the ball 30 is initially thrown onto the floor 12, wherein the ball 30 will roll into contact with one of the first figures 28. The ball 30 may be passed to another first figure 28 by spinning, pushing and pulling the rods. The opposing player may attempt to steal the pass by manipulating his own player figures. The player may spin the rod to project the ball 30 into the hoop 18 of the opposing player. The opposing player may rotate the second rod 24 to vertically move the second player figure 46 to block the shot of the first player. If the ball 30 goes through the hoop 18 the player is accredited with a certain number of points (typically two points per basket). The game 10 may have a counter (not shown) that simulates a scoreboard and which counts the points accumulated by each player. The game is played by continually passing and shooting the ball toward the hoop 18 of the opposing player.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A table top basketball game, comprising:

a floor that has a plurality of recess areas that are separated by a plurality of ramped surfaces and a plurality of recess channels that extend through said ramped surfaces between said recess areas;

a hoop suspended above said floor;

a ball that can roll along said floor through said recess channels between said recess areas;

a rod that can spin and move in a lateral direction relative to said floor; and, a first player figure that is attached to said rod such that said first player figure can move relative to said floor and be rotated to project said ball into said hoop and move said ball through said recess channels.

2. The game as recited in claim 1, wherein said floor has a recess area adjacent to said first player figure.

3. The game as recited in claim 2, wherein said recess area forms a ramp surface.

4. The game as recited in claim 1, further comprising a second player figure that moves in a vertical direction relative to said floor.

5. The game as recited in claim 4, wherein said second player figure is coupled to a spring and a lever that is rotated by a second rod, wherein rotation of said second rod initially moves said second player figure in a downward direction and compresses said spring, and continued rotation of said second rod disengages said lever from said second player figure such that said spring pushes said second player figure is an upward direction.

6. The game as recited in claim 5, wherein said second player figure is coupled to said second rod so that said second player figure moves in a lateral direction relative to said floor.

7. A table top basketball game, comprising:

a floor that has a pair of opposite ends;

a pair of opposing walls that extend along said floor;

a pair of backboards attached to said ends of said floor;

a pair of hoops attached to said backboards;

a ball that can roll along said floor;

a plurality of first rods that are separated from each other and are supported by said walls, said first rods each have a handle that allows a player to spin said rod and move said rod in a lateral direction relative to said floor;

a plurality of second rods that are located adjacent to said hoops, separated from said first rods and supported by said walls, said second rods each have a handle that allows a player to spin said rod and move said rod in a lateral direction relative to said floor;

a plurality of first player figures that are attached to said first and second rods such that said first player figures can move relative to said floor and be rotated to project said ball into said hoops;

a pair of second player figures that are adjacent to said hoops and are coupled to said second rods so that rotation of said second rods will induce a vertical movement of said second player figures;

a pair of levers that are coupled to said second rods and said second players, said levers move said second players in a downward direction when said second rods are rotated, further rotation of said second rods disengage said levers from said second players; and;

a pair of springs that push said second players in an upward direction when said levers become disengaged from said second players.

8. The game as recited in claim 7, wherein said floor has a plurality of recess areas that are adjacent to said first player figures.

9. The game as recited in claim 5, wherein said recess areas form a plurality of ramp surfaces.

10. The game as recited in claim 9, wherein said first player figures each have an opening that captures said ball.

* * * * *

UNITED STATES PATENT AND TRADEMARK OFFICE

CERTIFICATE OF CORRECTION

PATENT NO. : 5,605,328

DATED : February 25, 1997

INVENTOR(S) : Rudell et al.

It is certified that error appears in the above-identified patent and that said Letters Patent is hereby corrected as shown below:

In column 6, claim 9 at line 7, please delete " 5 " and insert -- 8 --.

Signed and Sealed this

Seventh Day of October, 1997

*Attest:*

Bruce Lehman

BRUCE LEHMAN

*Attesting Officer*

*Commissioner of Patents and Trademarks*